US007530740B2

(12) United States Patent
Geyer

(10) Patent No.: US 7,530,740 B2
(45) **Date of Patent: *May 12, 2009**

(54) MULTI-HANDLE HIGH STRENGTH PLASTIC BAG

(75) Inventor: Thomas E. Geyer, Cincinnati, OH (US)

(73) Assignee: Ampac Plastics LLC, Cincinnati, OH (US)

( * ) Notice: Subject to any disclaimer, the term of this patent is extended or adjusted under 35 U.S.C. 154(b) by 740 days.

This patent is subject to a terminal disclaimer.

(21) Appl. No.: 11/079,033

(22) Filed: Mar. 14, 2005

(65) Prior Publication Data

US 2005/0157956 A1 Jul. 21, 2005

Related U.S. Application Data

(63) Continuation-in-part of application No. 10/170,773, filed on Jun. 13, 2002, now abandoned.

(51) Int. Cl.
*B65D 33/14* (2006.01)
*B65D 33/08* (2006.01)
*B65D 33/24* (2006.01)

(52) U.S. Cl. ..... 383/5; 383/10; 383/84

(58) Field of Classification Search ..... 383/5, 383/10, 16, 17, 18, 22, 24, 84
See application file for complete search history.

(56) References Cited

U.S. PATENT DOCUMENTS

| | | | | |
|---|---|---|---|---|
| 3,383,017 | A | 5/1968 | Krings | |
| 3,402,749 | A | 9/1968 | Kinzler | |
| 4,343,053 | A * | 8/1982 | O'Connor | 4/452 |
| 4,528,694 | A | 7/1985 | Skovgaard | |
| 4,576,316 | A * | 3/1986 | Foster | 222/541.6 |
| 4,733,817 | A * | 3/1988 | Makowka | 229/69 |
| 4,790,670 | A | 12/1988 | Barbaro | |
| 5,061,086 | A * | 10/1991 | Vallerga | 383/16 |
| 5,108,194 | A | 4/1992 | Raden | |
| D327,217 | S | 6/1992 | Wallace | |
| 5,378,220 | A | 1/1995 | Bunn | |
| 5,407,277 | A | 4/1995 | Burke et al. | |
| 5,582,853 | A | 12/1996 | Marnocha et al. | |
| 5,631,068 | A | 5/1997 | Smith | |

(Continued)

FOREIGN PATENT DOCUMENTS

| | | |
|---|---|---|
| DE | 1486208 | 2/1969 |

(Continued)

OTHER PUBLICATIONS

Ampac Plastics LLC, Sample of plastic retail security bag, first produced circa 1999-2000.

*Primary Examiner*—Jes F Pascua
(74) *Attorney, Agent, or Firm*—Wood, Herron & Evans, LLP

(57) ABSTRACT

A high strength plastic bag is formed from two sheets of polymeric material. The sheets are folded, machined, and heat sealed to form a receptacle portion, a flap for covering an opening to the receptacle portion and handles to facilitate handling of the bag when filled. At least one handle has three layers of polymeric material for improved strength. The bag includes a tamper-indicating closure and has a high friction coefficient to prevent sliding of stacked bags.

3 Claims, 6 Drawing Sheets

U.S. PATENT DOCUMENTS

| | | | | |
|---|---|---|---|---|
| 5,782,562 | A | 7/1998 | Anspacher | |
| 5,908,243 | A | 6/1999 | Hanning | |
| 6,149,555 | A | 11/2000 | Kinback | |
| 6,190,043 | B1 * | 2/2001 | Diplock | 383/5 |
| 6,196,716 | B1 | 3/2001 | Geyer | |
| 6,264,033 | B1 * | 7/2001 | Kannabiran et al. | 206/459.1 |
| 6,315,448 | B1 | 11/2001 | Thrall | |
| 6,431,752 | B1 * | 8/2002 | Diplock | 383/5 |
| 6,604,857 | B2 * | 8/2003 | Buchanan et al. | 383/6 |
| 6,702,460 | B1 * | 3/2004 | Geyer | 383/5 |
| 6,886,980 | B1 * | 5/2005 | Diplock | 383/10 |
| 7,195,396 | B2 * | 3/2007 | Diplock | 383/10 |
| RE40,357 | E * | 6/2008 | Geyer | 383/5 |

FOREIGN PATENT DOCUMENTS

| | | | |
|---|---|---|---|
| EP | 0430558 | | 6/1991 |
| EP | 430558 | A1 * | 6/1991 |
| FR | 1345100 | | 10/1963 |
| GB | 2149381 | | 6/1985 |
| GB | 2200337 | | 8/1988 |
| GB | 2238291 | | 5/1991 |
| GB | 2238292 | | 5/1991 |
| GB | 2250011 | | 5/1992 |

* cited by examiner

MULTI-HANDLE HIGH STRENGTH PLASTIC BAG

This application is a continuation-in-part of U.S. patent application Ser. No. 10/170,773 filed Jun. 13, 2002, now abandoned.

FIELD OF THE INVENTION

This invention relates to plastic bags, and more particularly to a high strength plastic bag.

BACKGROUND OF THE INVENTION

Plastic bags have been widely used to contain various articles. Such plastic bags include tamper-indicating bags, which have been used to secure sensitive or valuable items during transit. These tamper-indicating bags have often been used to transfer money in the form of paper money, checks, or coins. The use of plastic bags to transfer coins presents several problems, however. For example, when plastic bags are used to accommodate more than a small number of coins, the bags need to be strong so they do not rupture under the weight of the coins. To make carrying the bag easier, the plastic bags require a means for grasping the bag. Prior plastic bags having handles to permit a user to grasp the bags are limited with respect to the amount of coins which may be contained in the bag because the heavy weight of a large number of coins tends to tear the bag at the handle. Furthermore, conventional plastic bags are susceptible to sliding against one another, making it difficult to stack the bags atop one another.

Prior plastic coin bags have been provided with single handles for lifting the bags. However, the lifting of very heavy coin bags by a single person may cause excessive strain or injury to those handling the bags. In such instances, at least two persons may be required to lift and maneuver the coin bags. Unfortunately, grasping of the handle by two persons at the same time is generally very awkward and may even increase the potential for injury to handlers.

There is thus a need for a high strength plastic bag which may be used to contain and transport coins, and which overcomes the drawbacks of prior art plastic bags.

SUMMARY OF THE INVENTION

The present invention provides a high strength plastic bag which may be used to contain and carry heavy items, such as coins. In one embodiment, the bag is formed from two sheets of polymeric material which have been, folded, die stamped, and heat sealed to create a receptacle portion, handle portions, and a flap portion. Multiple handles on the bag facilitate lifting and handling by more than one person at a time.

The handle portions of the bag include apertures which permit users to grasp the bag, and at least one handle portion comprises three layers of high strength polymeric material that have been joined with heat seals to provide added strength to the handle.

The flap portion of the bag covers an opening to the receptacle and may be sealed over the opening with a tamper-evident adhesive to secure the bag. In one embodiment, the flap portion further includes a removable receipt which may be detached from the bag for record keeping purposes. In another embodiment, a second removable receipt is formed on a handle portion of the bag.

In yet another embodiment, the bag is formed from polymeric material having a high friction coefficient so that the bags may be stacked atop one another without slipping.

The features and objectives of the present invention will become more readily apparent from the following Detailed Description taken in conjunction with the accompanying drawings.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the invention.

DETAILED DESCRIPTION

Figure 1:
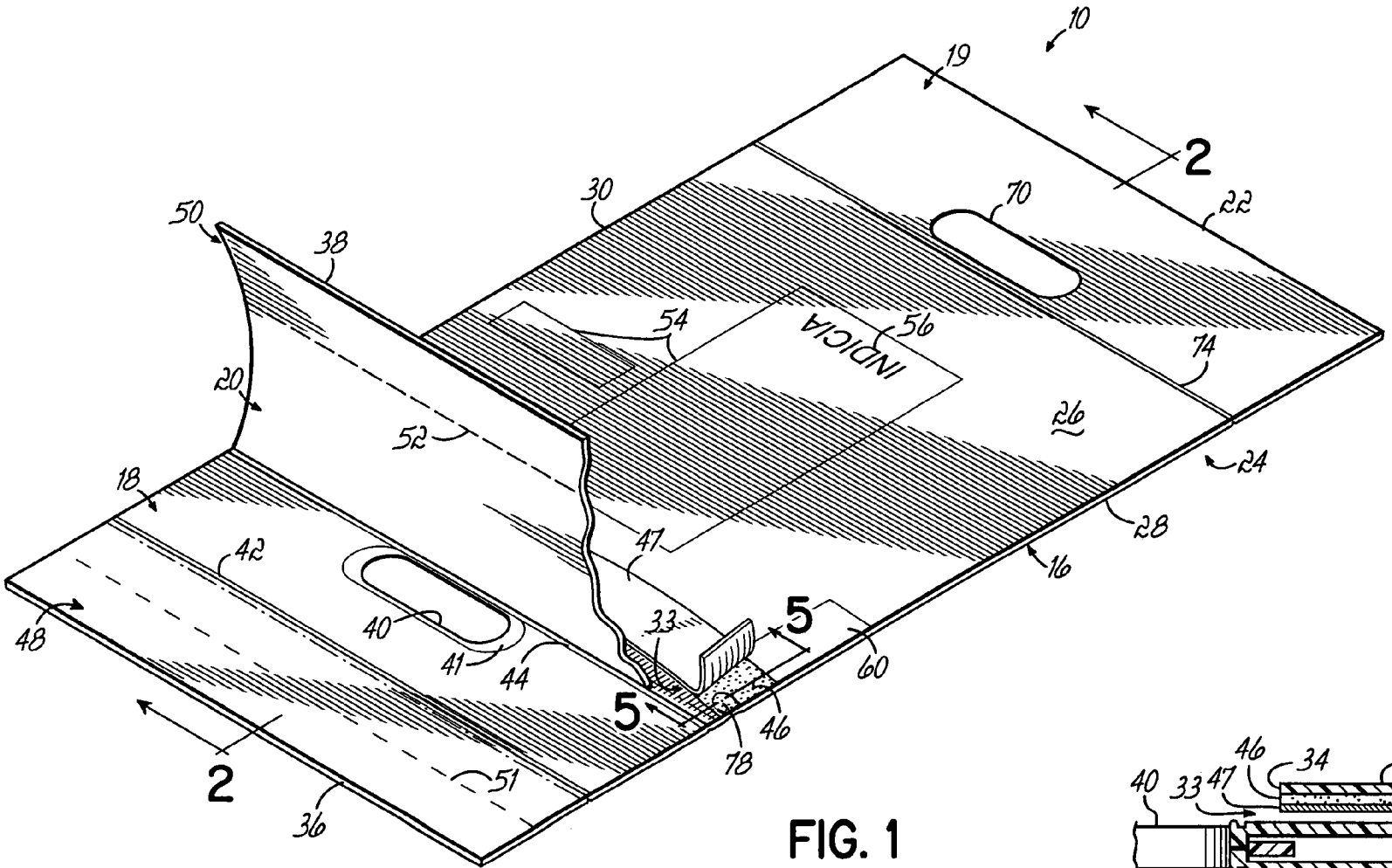
FIG. 1 is a perspective view of an exemplary plastic bag of the present invention.
Figure 2A:
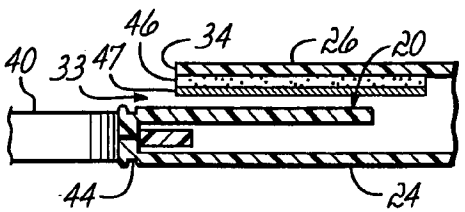
FIG. 2 is a cross-section of the bag shown in FIG. 1, taken along lines 2-2.
Figure 2:
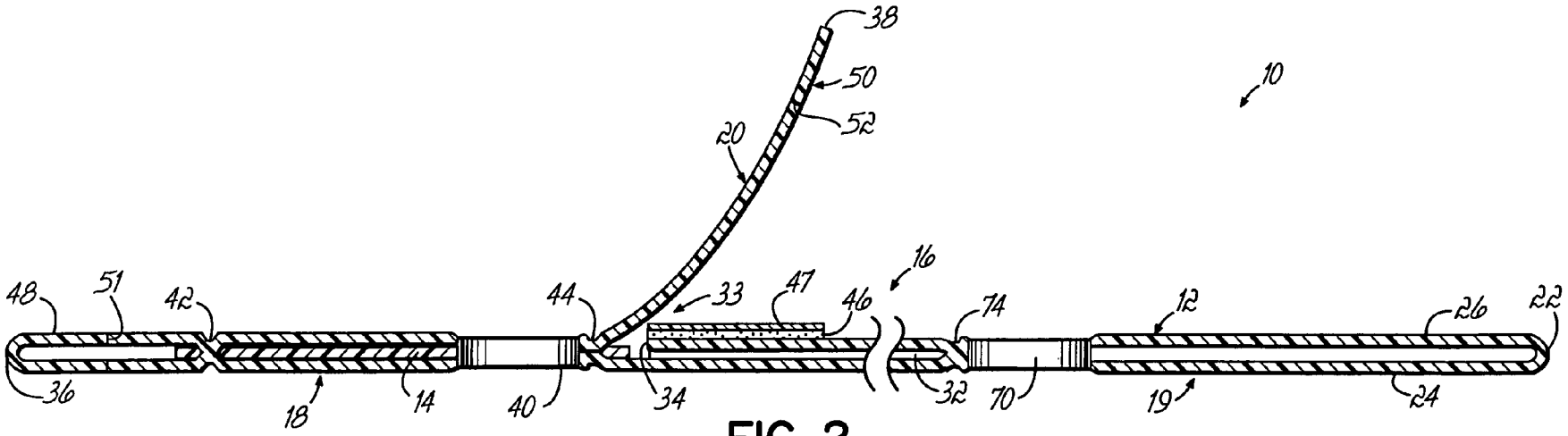

Referring to FIGS. 1-2, there is shown an exemplary plastic bag 10 of the present invention. The plastic bag 10 is formed from one or two sheets of plastic material 12, 14. The first sheet 12 is folded in an overlapping manner and heat sealed to form an interior compartment. First sheet 12 is also folded together with the second sheet 14 to form a first handle for carrying the bag 10.

As formed, the bag 10 includes a receptacle portion 16, first and second handle portions 18, 19 and a flap portion 20. The receptacle portion 16 of the bag 10 is formed by folding the first sheet 12 over itself to form a first folded edge 22 and first and second overlapping layers 24, 26. The first handle portion 18 and the flap portion 20 of the bag 10 are formed by folding the first layer 24 of the first sheet 12 back over itself to create a second folded edge 36 whereby the free edge 38 of the first layer 24 extends beyond the free edge 34 of the second layer 26. When the side edges 28, 30 of the folded sheet are heat sealed, the first and second layers 24, 26 of the first sheet 12 form a compartment 32 defined by the sealed edges 28, 30 and a lateral heat seal 74. The interior of the compartment 32 may be accessed by an opening 33 created by the unsealed free edge 34 of the second layer 26.

Handle portion 18 may further include a second plastic sheet 14 inserted between the folds of the first layer 24 of the first sheet 12 so that at least part of the first handle portion 18 comprises three layers of plastic. The first handle portion 18 further includes a first aperture 40 formed through the three layers of the first handle portion 18 at a distance from an end of the bag 10. In an exemplary embodiment, the first aperture 40 is formed such that a peripheral edge of aperture 40 is approximately 2½ to 4 inches, and preferably approximately 3 inches from an end of the bag 10. First handle portion 18 will generally include a heat seal around the perimeter of aperture 40, and may further include a second reinforcing heat seal 41 around first aperture 40 and upper and lower heat seals 42, 44 above and below the first aperture 40 to join the three layers of plastic material.

The second sheet 14 of the first handle 18 is a polymeric sheet which has been developed for strength and heat sealability. It can be formed from standard polyolefins, blends or coextrusions. In an exemplary embodiment, the second sheet 14 has inner and outer layers formed from a blend of linear low density polyethylene and metalocene and a stiffening middle layer, such as high density polyethylene (HDPE).

The second handle portion 19 is formed near the first folded edge 22, in a manner similar to the formation of the first handle portion 18. A second aperture 70 is formed through the first and second overlapping layers 24, 26 and at a distance from the first folded edge 22, whereby the distance between the first folded edge 22 and the nearest peripheral edge of the second aperture 70 is approximately 2½ to 4 inches, preferably 3 inches. As described above with respect to first aperture 40, second aperture 70 will generally be heat sealed around its perimeter to join first and second layers 24, 26 at the aperture 70.

Figure 4:
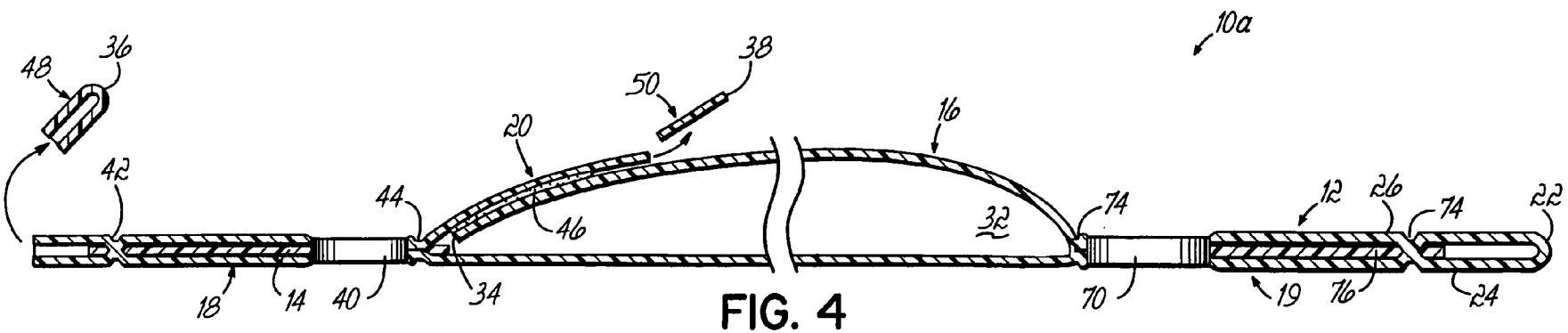
FIG. 4 is a cross-section of the bag of FIG. 3, taken along line 4-4 and depicting the bag in a sealed condition with first and second receipts detached from the bag.
Figure 3:
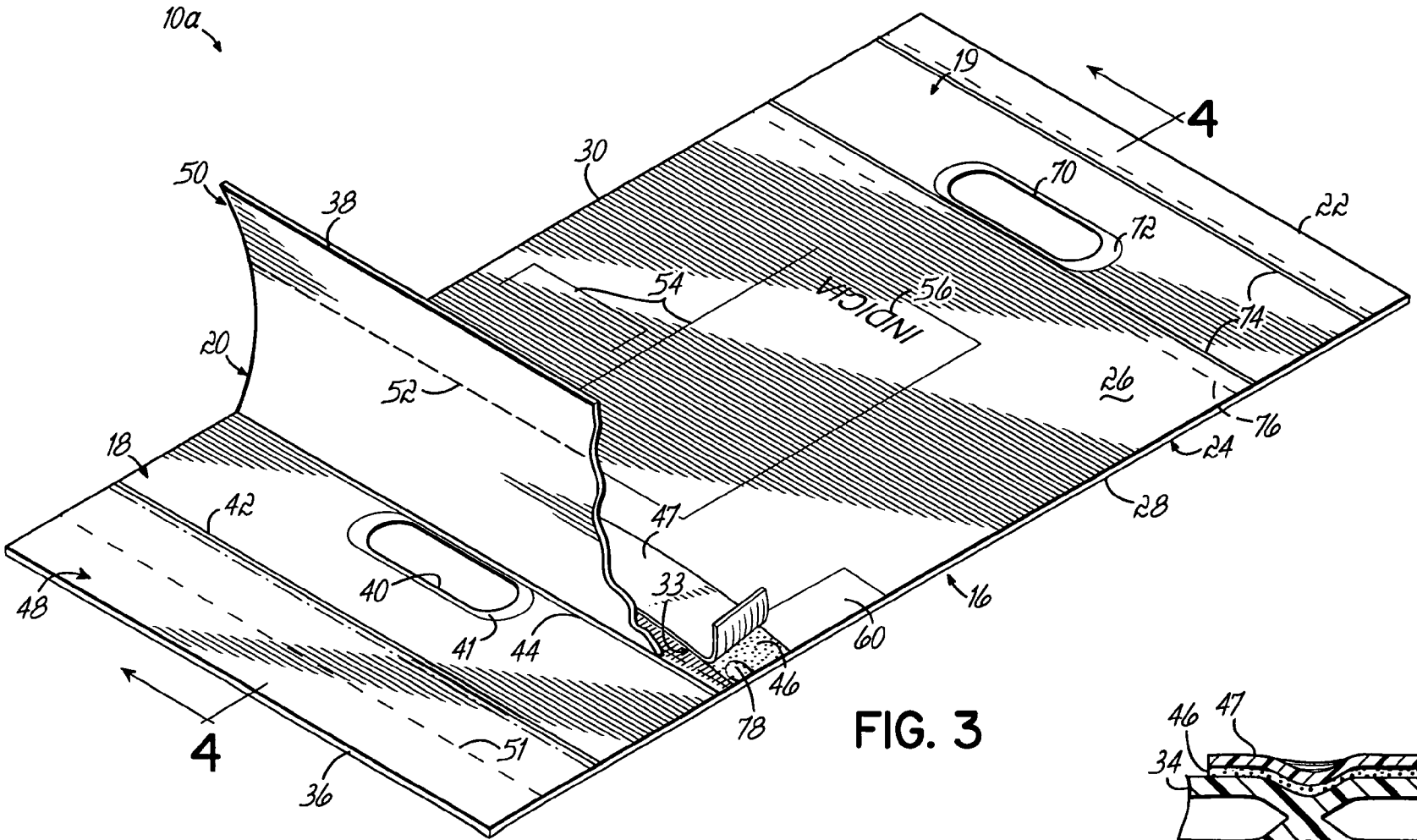
FIG. 3 is a perspective view of an alternative embodiment of a plastic bag of the present invention.

FIGS. 3-4 depict an alternative embodiment of the present invention. In these drawings like numbers are used to identify like elements from FIGS. 1 and 2. Referring further to FIGS. 3-4, bag 10*a* includes second handle portion 19 having a second reinforcing heat seal 72 around the perimeter of second aperture 70, as described above for first handle portion 18. At least one lateral heat seal 74 joins the first and second overlapping layers 24, 26 in the vicinity of the second aperture 70. FIGS. 1-2 depict an exemplary bag 10 where second aperture 70 does not have a reinforcing heat seal 72 and only one lateral heat seal 74 is formed near the second aperture 70. FIGS. 3-4 depict an alternative exemplary bag 10*a*, having a reinforcing seal 72 around the perimeter of second aperture 70, and having two lateral heat seals 74 near second aperture 70.

In the exemplary embodiment shown in FIGS. 3-4, an optional third sheet 76 of polymeric material is positioned between the first and second overlapping layers 24, 26, such that the second aperture 70 is formed through the first and second overlapping layers 24, 26 and the third sheet 76 sandwiched therebetween. In this embodiment, the lateral heat seal 74 and the reinforcing seal 72 around the perimeter of the second aperture 70 join the three layers of plastic material 24, 26, 76 in the vicinity of the second aperture 70. The third sheet 76 is formed from the same materials and in the same manner as the second sheet 14, described above.

The flap portion 20 extends over the opening 33 formed by the free edge 34 of the second layer 26 of the first sheet 12 to form a closure for the bag. In the exemplary embodiment shown, the bag 10 is provided with an adhesive 46 applied to the second layer 26 of the first sheet 12 near the opening 33 created by the free edge 34, whereby the flap 20 may be bonded to the second layer 26 to seal the bag 10. A release liner 47 may be provided over the adhesive 46 to protect the adhesive 46 from contamination and to prevent premature bonding prior to sealing the bag 10.

Preferably, the adhesive 46 is a tamper-indicating adhesive and the bag 10 is printed with tamper-indicating ink near the opening 33, as described more fully in U.S. Pat. No. 6,196,716 to Geyer, incorporated by reference herein in its entirety. After the bag 10 is sealed as described above, the tamper-indicating adhesive 46 provides an indication of when the flap portion 20 has been opened the first time. In this manner, the plastic bag 10 provides a secure means for containing sensitive or valuable items.

In FIG. 2A, an optional embodiment for sealing the bag 10 is shown an described. This optional sealing configuration can be used with any of the various bag embodiments shown and described herein. In this embodiment, flap 20 extends through opening 33 into the interior compartment 32 defined by the first and second layers 24, 26 of the folded first sheet 12. Adhesive 46 is applied to the interiorly-facing side of the second layer 26 of first sheet 12, near the opening 33 defined by free edge 34, whereby flap 20 may be bonded to the second layer 26 to seal the bag. A release liner 47 may be provided over the adhesive 46 to protect the adhesive from contamination and to prevent premature bonding of the second layer 16 and flap 20 prior to sealing the bag, as described above.

Figure 5:
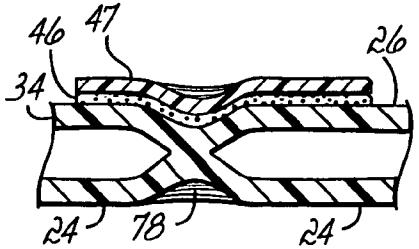
FIG. 5 is a partial cross-section of the bag of FIG. 1, taken along line 5-5.

Preferably, bag 10 further includes spot seals 78 at side edges 28, 30 near opening 33, as shown in FIGS. 1, 4 and 5. Advantageously, spot seals 78 reinforce bag 10 at opening 33 to provide increased resistance to tearing at edges 28, 30 when flap 20 is pulled to reopen bag 10 after sealing with adhesive 46.

The plastic bag 10 further includes one or more receipt portions 48, 50 which may be removed from the bag 10 for record keeping purposes. In the exemplary embodiments shown, bag 10 includes two receipt portions 48, 50 which may be removed from the bag 10. A first receipt portion 48 is removably attached to the first handle portion 18 of the bag 10, and a second receipt portion 50 is removably attached to the flap portion 20 of the bag 10. In the exemplary embodiments, the receipt portions 48, 50 are formed by perforations 51, 52 formed on the bag 10 at a distance from the edges 36, 38 of the first handle 18 and flap portion 20 to create a removable strip of plastic material. It will be recognized, however, that the bag 10 may have only one removable receipt portion, or no receipt portions, and that the receipt portions may be provided on different parts of the plastic bag 10. Ink or other visible material may be applied to the bag 10 to create viewable areas 54 for marking the bag 10 with indicia 56. Such markable areas 54 are particularly useful on the receptacle and receipt portions 16, 48, 50, but may be applied to any portion of the bag 10 as desired.

A high strength plastic bag 10 as described above may be formed from two sheets of plastic material 12, 14 according to the following exemplary method. The first sheet 12 of polymeric material is folded to form a first folded edge 22 and first and second overlapping layers 24, 26 whereby the first layer 24 extends beyond a free edge 34 of the second layer 26. A second sheet 14 of polymeric material may be positioned on a portion of the first layer 24 of the first sheet 12, at a distance from the free edge 34 of the second layer 26. The first layer 24 of the first sheet 12 is folded over a portion of the second layer 26 of the first sheet 12, forming a second folded edge 36 and a flap 20 which covers the free edge 34 of the second layer 26. When second sheet 14 is positioned on first layer 24, folding the first layer 24 over the second layer 26 sandwiches the second sheet 14 between the folds of the first layer 24.

The first and second side edges 28, 30 of the first folded sheet 12 are heat sealed to define an interior compartment 32 between the first and second overlapping layers 24, 26 of the first sheet 12 and an opening 33 to the interior compartment 32 at the free edge 34 of the second layer 26. The first sheet 12 of polymeric material is perforated near the second folded edge 36 to define a first removable receipt 48. The first sheet 12 of polymeric material is perforated near the edge 38 of the flap 20 to define a second removable receipt 50.

A first aperture 40 is formed through the folds of the first layer 24 of the first sheet 12 and through the second sheet 14 sandwiched between the folds of the first sheet 12, so that a peripheral edge of aperture 40 is approximately 2.5 to 4 inches from the perforation defining the first removable receipt 48. A second aperture 70 is formed near first folded edge 22 at a distance of approximately 2.5 to 4 inches from the first folded edge 22. In an exemplary method, first and second sheets 12, 14 are sealed with a reinforcing heat seal around the perimeter of first aperture 40 and at locations 42, 44 above and below first aperture 40.

In another exemplary method, first and second overlapping layers 24, 26 are heat sealed around the perimeter of second aperture 70, and at least one lateral heat seal 74 is formed to join first and second overlapping layers 24, 26 in the vicinity of second aperture 70.

In yet another exemplary method, a third sheet 76 of polymeric material is positioned between the first and second overlapping layers 24, 26, such that the second aperture 70 is formed through the first and second overlapping layers 24, 26 and the third sheet 76 sandwiched therebetween. In this embodiment, the lateral heat seal 74 and the reinforcing seal 72 around the perimeter of the second aperture 70 are formed to join the three layers of plastic material 24, 26, 76 in the vicinity of the second aperture 70.

Indicia 56 may be printed on any portion of the plastic bag 10 either before or after formation of the bag 10. In an exemplary embodiment, ink 60 is applied to portions of the first sheet 12 near the side edges 28, 30 and the opening 33 formed by the free edge 34 of the second layer 26 of the first sheet 12. The ink 60 applied in these areas prevents the flap portion 20 of the bag 10 from sealing against the bag 10 when the bag 10 is formed.

Advantageously, the second handle portion 19 permits bag 10 to be easily grasped and handled by two persons. This is especially useful when a bag 10 is filled with heavy items, such as a large quantity of coins, and it is necessary or desirable for two persons to handle the bag 10.

Figure 6:
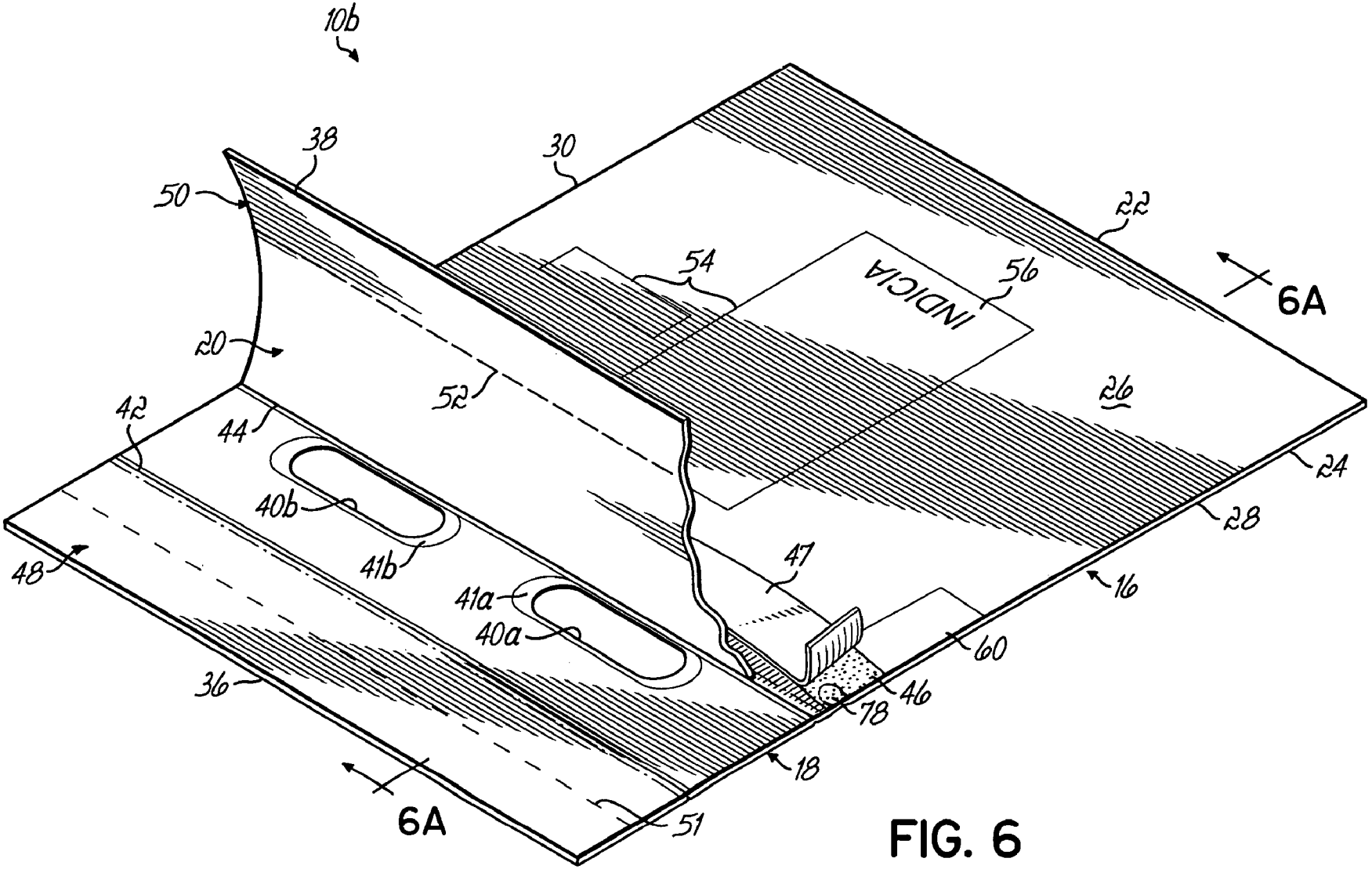
FIG. 6 is a perspective view of a third embodiment of a plastic bag according to the invention.
Figure 6A:
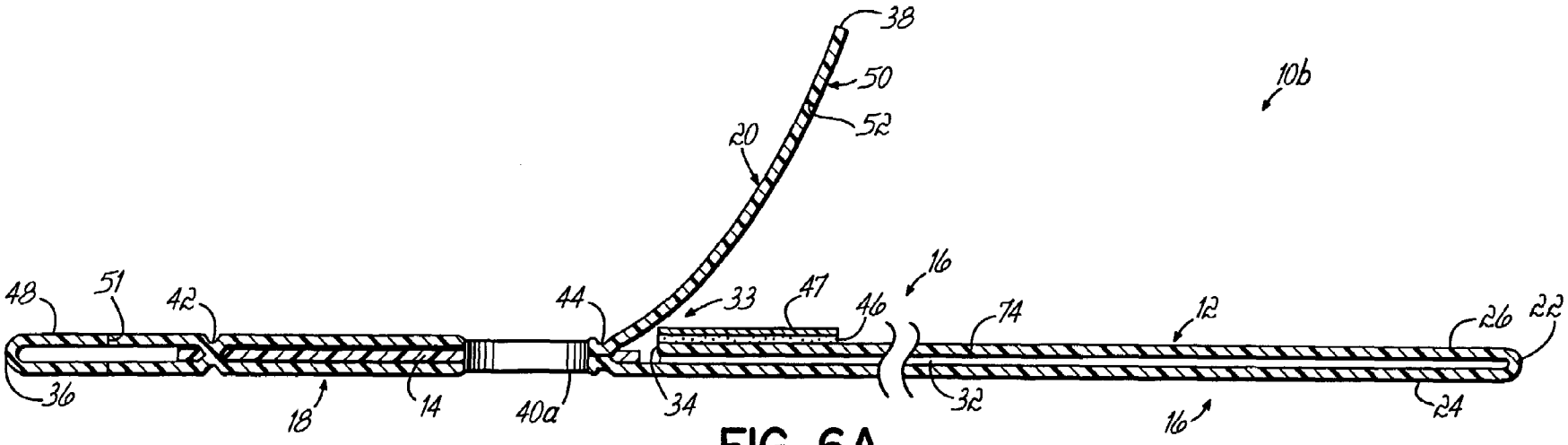
FIG. 6A is a cross-sectional view of the bag of FIG. 6, taken along line 6A-6A.

FIGS. 6 and 6A depict yet another exemplary plastic bag 10*b* according to the present invention. Plastic bag 10*b* is similar in many respects to the plastic bags 10, 10*a* discussed above with respect to FIGS. 1-5, and similar features have been similarly numbered. In particular, plastic bag 10*b* is formed from two sheets of plastic material 12, 14 folded and heat sealed as described above. Alternatively, bag 10*b* may be formed using only a single sheet of plastic material 12, folded and heat sealed as described above.

Bag 10*b* includes a receptacle portion 16, a handle portion 18, and a flap portion 20. The receptacle portion 16 is formed by folding the first sheet 12 over itself to form first folded edge 22 and first and second overlapping layers 24, 26, as described above. The handle portion 18 and the flap portion 20 are formed by folding first layer 24 of the first sheet 12 back over itself to create a second folded edge 36 such that the free edge 38 of the first layer 24 extends beyond the corresponding free edge 34 of the second layer 26. The handle portion 18, above the receptacle portion 16, includes first and second spaced-apart apertures 40*a*, 40*b* formed through the first and second layers 24, 26. When it is desired to further increase the strength of the handle portion 18, a second plastic sheet 14 may be inserted between the folds of the first layer 24 of the first sheet 12 such that at least part of the handle portion 18 comprises three layers of plastic material. First handle portion 18 will generally include heat seals around the perimeter of the apertures 40*a*, 40*b*, and may further include second reinforcing heat seals 41*a*, 41*b* around the apertures 40*a*, 40*b*, and upper and lower heat seals 42, 44 positioned above and below the apertures 40*a*, 40*b*.

Plastic bag 10*b* further includes a first receipt portion 48 removably attached to the handle portion 18, and a second receipt portion 50 removably attached to the flap portion 20, similar to plastic bags 10, 10*a* discussed above. In these embodiments, the receipt portions 48, 50 are formed by perforations 51, 52 formed into the bag 10*b* at distances spaced from respective edges 36, 38 of the handle portion 18 and flap portion 20 to create removable strips of plastic material.

Other features of plastic bag 10*b* are similar to those described above with respect to plastic bags 10, 10*a*. The first and second apertures 40*a*, 40*b* on the handle portion 18 facilitate grasping and carrying the plastic bag 10*b* by two hands of a user, or alternatively two different users may each grasp one of the apertures 40*a*, 40*b* to cooperatively carry a filled bag 10*b*.

Figure 7:
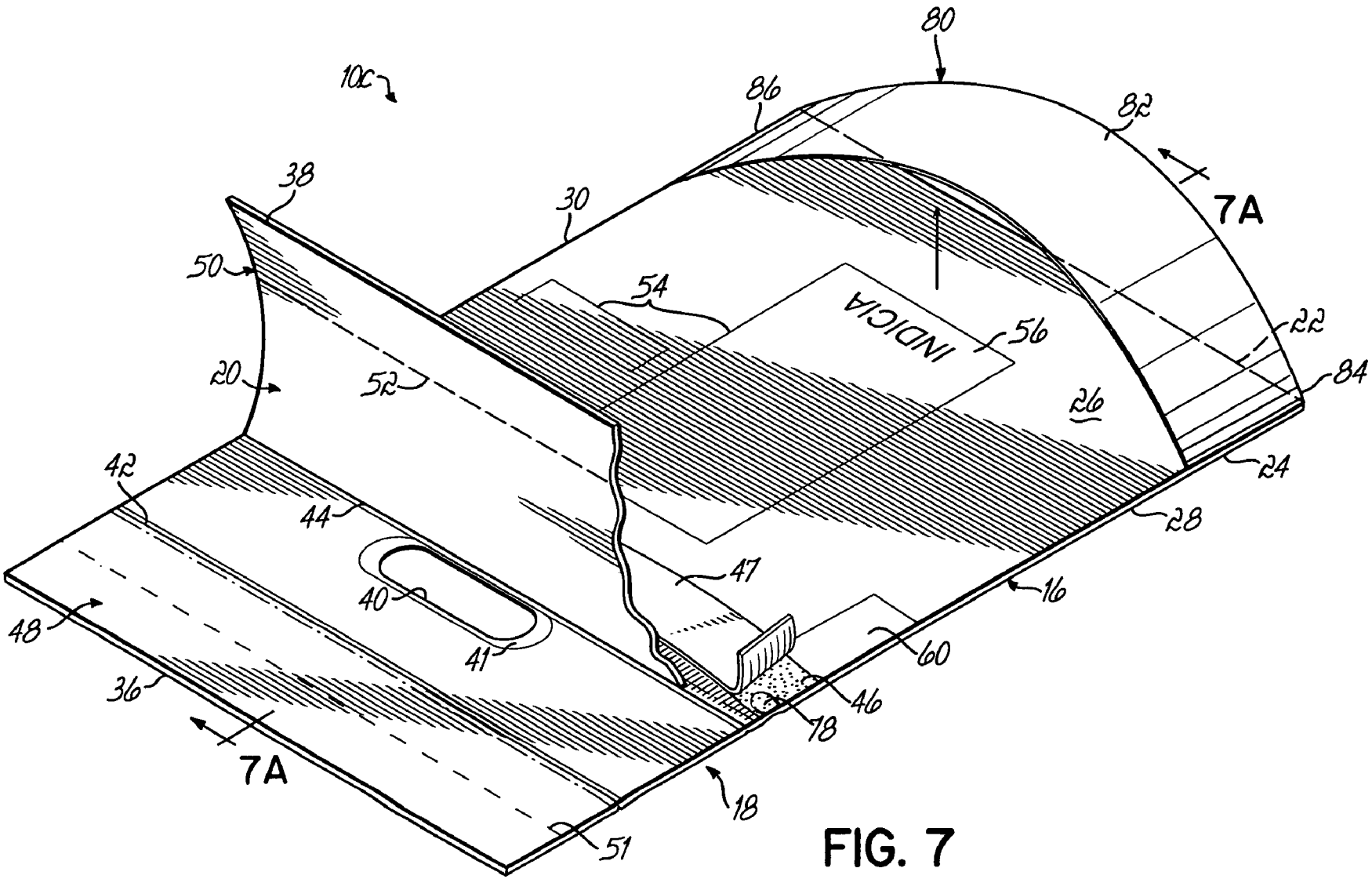
FIG. 7 is a perspective view of a fourth embodiment of a plastic bag according to the present invention.
Figure 7A:
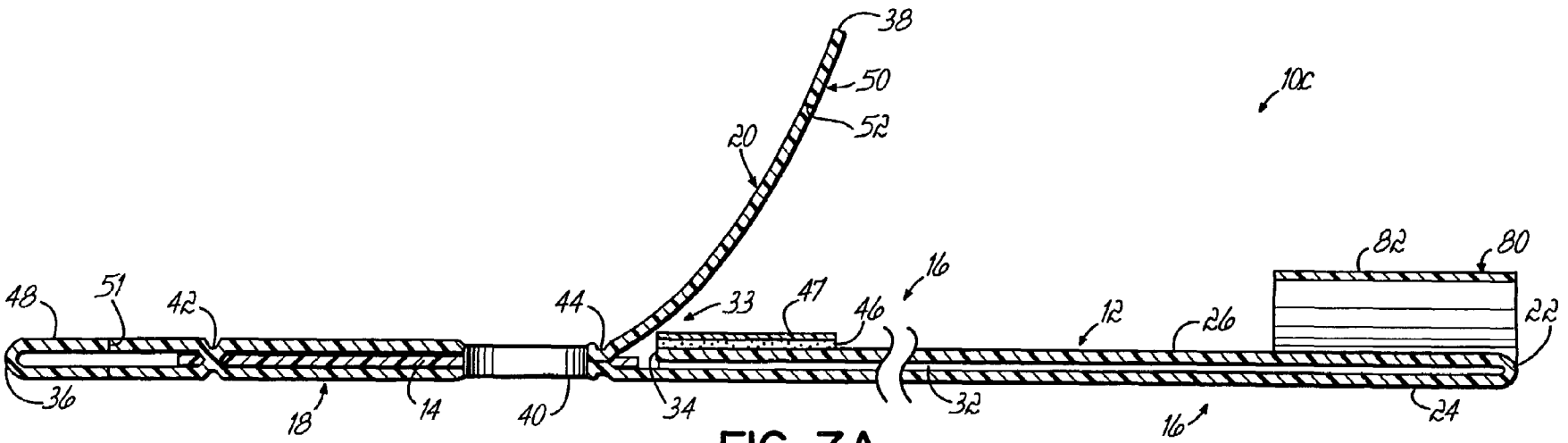
FIG. 7A is a cross-sectional view of the bag of FIG. 7, taken along line 7A-7A.

Referring now to FIGS. 7 and 7A, there is shown yet another embodiment of a plastic bag 10*c* according to the present invention. Plastic bag 10*c* includes many features in common with plastic bags 10, 10*a*, 10*b* shown and described above, and these similar features are similarly numbered. In particular, plastic bag 10*c* comprises a receptacle portion 16, a handle portion 18 and a flap portion 20. The receptacle portion is formed by folding a first sheet 12 of plastic material over itself to form a first folded edge 22 and first and second overlapping layers 24, 26. The receptacle portion is formed from at least a portion of the first and second overlapping layers 24, 26 which define first and second opposing walls and an interior cavity 32 for receiving articles through opening 33, as described above.

First layer 24 of the first sheet 12 is folded back over itself to create a second folded edge 36 having a free edge 38 that extends beyond the free edge 34 of the second layer 26 to thereby define a first handle portion 18 and a flap portion 20. An aperture 40 is formed through the first handle portion 18 so that a peripheral edge of aperture 40 is spaced from the end of the bag and generally includes a heat seal around its parameter. If it is desired to further increase the strength of the first handle portion 18, a second plastic sheet 14 may be inserted between the folds of the first layer 24 of the first sheet 12 such that at least a part of the first handle portion 18 comprises three layers of plastic material. First handle portion 18 may further include a second reinforcing heat seal 41 around the aperture 40 and upper and lower heat seals 42, 44 positioned above and below the aperture 40.

Plastic bag 10*c* further includes first and second removable receipt portions 48, 50 removably attached to the first handle portion 18 and the flap portion 20, respectively and defined by perforations 51, 52 formed into the bag 10, as described above. It will be recognized, however, that the bag 10*c*, as well as any of the other bag embodiments of the present invention, may have only one removable receipt portion, or no receipt portions, and that the receipt portions may be provided on various other parts of the plastic bag 10*c*.

Plastic bag 10*c* further includes a second handle portion 80 comprising an elongate strip 82 of plastic material having distal ends 84, 86 joined to at least one of the first and second layers 24, 26 to define a loop intermediate the distal ends 84, 86. In the embodiment shown, the distal ends 84, 86 are heat sealed along side edges 28, 30 of the receptacle portion 16, and the second handle portion 80 is positioned at an end of the bag 10*c* generally opposite first handle portion 18. It will be recognized, however, that second handle portion 80 may alternatively be joined to other portions of the first sheet 12 such as along only one of the side edges 28, 30, a position intermediate respective folded edges 22, 36, or at a position overlapping first handle portion 18, for example.

While the elongate strip of plastic material 82 has been shown and described joined to first sheet 12 by heat sealing, it will be recognized that the elongate strip 82 may alternatively be joined to the first sheet 12 by other methods, such as by adhesives, fasteners or any other method suitable for securing the elongate strip 82 to the bag 10*c* to define the second handle portion 80. The loop defined by second handle portion 80 may be used like a shoulder strap to facilitate carrying a filled plastic bag 10*c*. Alternatively, plastic bag 10*c* may be carried by two persons, whereby a first person grasps the first handle portion 18 through aperture 40, and a second person grasps second handle portion 80.

While the present invention has been illustrated by the description of the various embodiments thereof, and while the embodiments have been described in considerable detail, it is not intended to restrict or in any way limit the scope of the appended claims to such detail. Additional advantages and modifications will readily appear to those skilled in the art. The invention in its broader aspects is therefore not limited to the specific details, representative apparatus and methods and illustrative examples shown and described. Accordingly, departures may be made from such details without departing from the scope or spirit of applicant's general inventive concept.

What is claimed is:

1. A plastic bag, comprising:

a receptacle portion having first and second opposing walls, said first and second walls joined substantially around the perimeters of said walls to define an interior cavity for receiving articles and having an opening permitting access to said interior cavity;

a handle portion above said receptacle portion, said handle portion comprising first and second spaced apart apertures;

a flap portion integral with said receptacle portion and proximate said opening, said flap portion extending over said opening;

tamper-indicating adhesive disposed on said receptacle portion proximate said opening to bond said flap portion over said opening to thereby seal the bag;

a first receipt portion frangibly attached to said handle portion; and a second receipt portion frangibly attached to said flap portion.

2. The bag of claim 1, further comprising:

upper and lower heat seals formed above and below said apertures.

3. The bag of claim 1, wherein said handle portion comprises first and second outer plastic layers and an interior plastic layer sandwiched between said first and second outer plastic layers.

* * * * *